US007820603B2

(12) United States Patent
Court et al.

(10) Patent No.: US 7,820,603 B2
(45) Date of Patent: Oct. 26, 2010

(54) LOW FOAMING CONVEYOR LUBRICANT COMPOSITION AND METHODS

(75) Inventors: Colin Court, Quakers Hill (AU); Antonella Petrella, Coogee (AU)

(73) Assignee: Ecolab USA Inc., St. Paul, MN (US)

( * ) Notice: Subject to any disclaimer, the term of this patent is extended or adjusted under 35 U.S.C. 154(b) by 546 days.

(21) Appl. No.: 11/080,138

(22) Filed: Mar. 15, 2005

(65) Prior Publication Data

US 2006/0211584 A1 Sep. 21, 2006

(51) Int. Cl.
*C10M 137/04* (2006.01)
*C10M 129/32* (2006.01)
*C10M 129/20* (2006.01)

(52) U.S. Cl. ..... 508/433; 508/527; 508/307

(58) Field of Classification Search ..... 508/433, 508/527, 307

See application file for complete search history.

(56) References Cited

U.S. PATENT DOCUMENTS

| | | | | |
|---|---|---|---|---|
| 5,062,979 | A | 11/1991 | Scharf | |
| 5,182,035 | A * | 1/1993 | Schmidt et al. | 508/527 |
| 5,352,376 | A * | 10/1994 | Gutzmann | 508/216 |
| 5,474,692 | A | 12/1995 | Laufenberg | |
| 5,559,087 | A | 9/1996 | Halsrud et al. | |
| 5,565,127 | A | 10/1996 | Laufenberg et al. | |
| 5,723,418 | A | 3/1998 | Person Hei | |
| 5,863,874 | A | 1/1999 | Person Hei | |
| 5,932,526 | A | 8/1999 | Person Hei | |
| 6,372,698 | B1 | 4/2002 | Strothoff | |
| 6,525,005 | B1 | 2/2003 | Kravitz | |
| 6,667,283 | B2 | 12/2003 | Kravitz | |
| 6,756,347 | B1 | 6/2004 | Besse | |
| 6,780,254 | B1 | 8/2004 | Schmitz | |

FOREIGN PATENT DOCUMENTS

| | | |
|---|---|---|
| EP | 1690920 | 8/2006 |
| JP | 6330079 | 11/1994 |

OTHER PUBLICATIONS

Gilbert, Peter, "*Conveyor Lubrication in Dairies, Breweries and Beverage Plants*" , Klensan (Pty) Ltd., S.A. Food Review—Dec. 1981/Jan. 1982, pp. 27-28, 2 pages.

Gorton, Hugh J. Ph.D. and Taylour, Jim M. PhD. C Chem., "*The Development of New Conveyor Lubricant Technology*", MBAA Technical Quarterly, vol. 30, pp. 18-22, 1993, 5 pages.

* cited by examiner

*Primary Examiner*—Glenn Caldarola
*Assistant Examiner*—Jim Goloboy
(74) *Attorney, Agent, or Firm*—Andrew D. Sorensen; Laura C. Dilorenzo; Amy J. Hoffman

(57) ABSTRACT

The invention relates to lubricant compositions, and methods especially as lubricants for the transport of glass, aluminum, and PET containers. The lubricant compositions contain a phosphate ester, an amine salt, and a nonionic surfactant.

17 Claims, No Drawings

LOW FOAMING CONVEYOR LUBRICANT COMPOSITION AND METHODS

FIELD OF THE INVENTION

The invention relates to lubricant compositions, and methods especially as lubricants for the transport of glass, aluminum, and PET (containers made of ethylene terephthalate homopolymers, copolymers, and mixtures thereof) containers. The lubricant compositions (hereinafter referred to as "compositions") contain a phosphate ester, an amine salt, and a nonionic surfactant.

BACKGROUND

In the food and beverage industry, containers are transported by conveyors, oftentimes at very high speeds. The containers may comprise many different materials including metals, glasses, papers such as treated papers and waxed papers, polymeric materials, and the like. During processing, the containers may sit on the conveyors for a period of time due to a back up on the conveyor. While the containers are stopped, the conveyor belt is often still moved continuously. In order to facilitate the smooth transportation of the containers on the conveyor, a lubricant composition is applied to the surface of the conveyor belt and/or the container.

In addition to having different types of containers and container materials, the conveyor may be made of different materials such as stainless steel and acetal. It is generally accepted in the industry that not all conveyor lubricants are equally effective at lubricating different types of container and conveyor materials, and some lubricants may be detrimental to certain materials such as polymeric containers. For example, phosphate esters are not as effective at lubricating a conveyor transporting glass containers. Further, lubricants such as amines, alcohols, and potassium hydroxide are incompatible with polymeric containers such as ethylene therephthalate homopolymers and copolymers (i.e. PET containers). It is known that exposure to incompatible lubricants will cause a phenomenon in PET containers called environmental stress cracking (crazing and cracking that occurs when the plastic polymer is under tension). Consequently, if a plant is using multiple types of container materials the plant usually has to switch conveyor lubricants when it changes the container on a line, or stock multiple lubricants which is time consuming and costly. It is against this background that the present invention has been made.

SUMMARY

Surprisingly, it has been discovered that universal lubrication across a variety of containers and conveyors may be achieved using (1) a phosphate ester, (2) an amine salt and (3) a nonionic surfactant. The present invention is effective at lubricating a variety of containers including metal, glass, and polymeric (i.e. PET) containers on conveyor surfaces including stainless steel and acetal conveyors. In some preferred embodiments, the nonionic surfactant selected is compatible with polymeric containers in that it does not promote stress cracking. In some embodiments, the present invention is low foaming.

These and other embodiments will be apparent to those of skill in the art and others in view of the following detailed description of some embodiments. It should be understood, however, that this summary, and the detailed description illustrate only some examples of various embodiments, and are not intended to be limiting to the invention as claimed.

DETAILED DESCRIPTION OF SOME EMBODIMENTS

As discussed above, the invention generally relates to lubricant compositions, and methods, especially as lubricants for the transport of glass, aluminum, and PET (containers made of ethylene terephthalate homopolymers, copolymers, and mixtures thereof) containers. In some embodiments, the compositions contain a phosphate ester, an amine salt, and a nonionic surfactant. In some embodiments, the nonionic surfactant is compatible with polymeric containers. In some embodiments, the compositions are preferably low foaming. In some embodiments, the compositions are substantially free of an antimicrobial agent. In some embodiments, the compositions include additional functional ingredients that enhance the effectiveness of the composition. Finally, in some embodiments, the invention includes a method of transporting a container on a conveyor where a lubricant composition having a phosphate ester, an amine salt, and a nonionic surfactant is applied to the conveyor or container.

Lubricant Composition and Use

The lubricant compositions may be a concentrate composition or a use composition. The concentrate composition refers to the composition that is diluted and then applied to the conveyor or container. The use composition refers to the composition that has been diluted from the concentrate and then applied to the conveyor or container. It is usually less expensive to ship a concentrate product and then dilute it on-site to form the use composition. The concentrate composition and the use composition may be a solid, liquid, paste, gel or other physical form. The concentrate composition and use composition are preferably liquids.

The composition may be applied to the conveyor or container as a concentrate composition (neat). In such embodiments, the concentrate provides a thin, substantially non-dripping lubricating film. In contrast to use compositions, the concentrate composition can provide a drier lubrication to the conveyor or container, a cleaner and drier conveyor line and working area, and reduced composition usage, thereby reducing waste, cleanup, and disposal problems. The composition may also be diluted and applied as a use composition. If the use composition is applied, it may be diluted to a composition having about 800 to about 10,000 ppm of the concentrate, about 100 to about 500 ppm of the concentrate, about 1250 to about 5000 ppm of the concentrate, and about 1650 to about 3300 ppm of the concentrate. If the composition is diluted to form a use composition, it may be diluted with a carrier or solvent. The most common carrier or solvent is water, however, the concentrate may also be diluted other solvents such as glycols and their derivatives and alcohols and their derivatives.

Typically when a lubricant is diluted it may have a tendency to foam. Foam is undesirable because it can be a carrier for microbial contaminants, damage packaging or labeling materials, cover packaging surfaces preventing label adherence, prevent automatic line inspectors from operating effectively, reduce lubrication performance, and in some instances be a safety hazard. Some lubricants are known to foam more than others. For example, phosphate ester based lubricants are known to foam. Also, amine based lubricants are known to foam. Surprisingly, it has been discovered that the combination of a phosphate ester and an amine-salt in the present invention produces a low foaming conveyor lubricant. This low foaming lubricant is desirable because it does not have the drawbacks discussed above.

If a lubricant is diluted, the dilution may be done either batchwise by adding a solvent or carrier into a container with a suitable amount of concentrate or the dilution may be done continuously online. Online dilution is usually done by the regulated injection of a stream of concentrate into a stream of water or other carrier or solvent, at a steady rate. The injection of the concentrate can be achieved by a pump, for example, a metering pump, although other injection means are possible. Water of varying quality may be used, for example hard water, soft water, tap water, and deionized water. The water may also be heated or cooled. If the composition is pumped onto the conveyor, it can be applied continuously, intermittently, or as a one time application. In some embodiments, only portions of the conveyor that contact the containers need to be treated. Likewise, in some embodiments, only portions of the container that contact the conveyor need to be treated. The lubricant can be formulated as a permanent composition that remains on the container or conveyor throughout its useful life, or can be a semi-permanent, or temporary composition.

In some embodiments, it may be desirable to provide one or more of the various composition components in separate containers until it is desired to make the final composition. This is especially true for in-process cleaning applications. For example, the phosphate ester, amine salt, and nonionic surfactant can be provided in separate containers until it is desired to make the composition. Such an arrangement allows for the separate components to be available for use in other compositions. The mixing of the components can be made in concentrates or mixed after dilution. The mixing of the dilution can be made at the point of application or before at the mechanical system of transporting the product to the intended use sites.

The conveyor that supports the container may be made of a wide variety of materials, for example, fabric, metal, plastic, elastomer, composites, or combinations or mixture of these materials. Any type of conveyor system used in the container field can be treated according to some embodiments of the invention.

The invention also includes a method of transporting a container on a conveyor by applying the lubricant composition to the conveyor or container. The composition may be applied in many ways including spraying, wiping, rolling, brushing, atomizing, dipping, and the like or a combination of any of these.

In some embodiments, it may be preferable for the compositions to have additional characteristics such as biodegradability, nontoxicity, food grade ingredients, ink and date code compatibility, and the like.

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The use of the terms "antimicrobial" in this application does not mean that any resulting products are approved for use as an antimicrobial agent.

In some embodiments, the phrase "low foaming" refers to a composition that has the capacity to substantially dissipate foam to an acceptable level at a rate as quickly or almost as quickly as it is generated. In some embodiments, the phrase "low foaming" refers to any material that generates foam that can free drain from conveyor surfaces, equipment surfaces, and drainage areas. In some embodiments, the phrase "low foaming" refers to a composition that creates only a thin film of foam when the lubricant composition "pools."

Phosphate Ester

As previously discussed, the present invention includes a phosphate ester. A phosphate ester generally refers to a composition having the formula $(RO_3)P{=}O$. In a preferred embodiment, the phosphate ester is an alkyl alkoxylated phosphate ester and more preferably an ethoxylated and/or propoxylated phosphate ester having the general structural formula:

$$R^1{-}O{-}(R^2O)_n{-}PO_3X_2$$

wherein $R^1$ comprises an alkyl group (e.g., linear, branched or cyclic alkyl group) of from 1 to 20 carbon atoms, preferably 8 to 12 carbon atoms, $R^2$ is selected from $-CH_2-CH_2-$ and

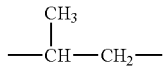

(ethylene and propylene)

n is 3 to 8 where $R^2$ is propylene, and 3 to 10 where $R^2$ is ethylene, and

X is hydrogen, alkanolamine and/or alkali metal.

Alkyl phosphate esters are available commercially under the names: Rhodafac (i.e., Rhodafac PC-100, Rhodafac PL-620, Rhodafac PL-6, and Rhodafac RA-600) from Rhodia, Inc. of Cranberry, N.J.; Emphos (Emphos PS-236) from Witco Corporation of Greenwich, Conn.; DePhos (i.e., DePhos RA-40, DePhos RA-60, DePhos RA-75, DePhos RA-80); and Ethfac (i.e., Ethfac 141, Ethfac 161, Ethfac 104, Ethfac 106, Ethfac 136, and Ethfac 124) of Ethox Chemicals, LLC of Greenville, S.C.

The phosphate ester is preferably a polyoxyethylene alkyl phosphate ester (acid form), such as the phosphate ester sold under the tradename Rhodafac RA 600, commercially available from Rhodia.

The concentrate preferably includes a sufficient lubricating amount of alkyl phosphate ester to provide the use composition with a desired lubricity. The amount of alkyl alkoxylated phosphate ester provided is sufficient to provide a desired level of lubricity. Too much alkyl alkoxylated phosphate ester increases viscosity and expense. In addition, the ratio of anionic and cationic species present in the lubricant composition should be sufficient to avoid phase separation. Accordingly, too little or too much alkyl alkoxylated phosphate ester relative to the other components can result in phase separation. The alkyl phosphate ester is preferably provided in the concentrate from about 1 wt. % to about 20 wt. %, from about 3 wt. % to about 15 wt. %, and from about 3 wt. % to about 8 wt. %.

Amine Salt

The present invention includes an amine salt. Amines are generally considered deleterious to polymeric materials because they form hydroxide ions in water and those hydroxide ions promote stress cracking. Further, some amines, for example diamines, have limited solubility in water. If an amine is converted to an amine salt, the amine salt does not promote stress cracking in polymeric materials, and the amine salt is soluble. An amine salt refers to the reaction product of an amine with an acid. An amine salt may be conveniently produced by reacting a suitable amine with an acid under conditions sufficient to product the amine salt. Generally, the acid will spontaneously neutralize the amine to form the amine salt under ambient conditions. The mole ratio of acid to amine should be at least 1:1 to permit substantially complete formation of the monoprotonated salt. The mole ratio of the acid to the amine should be about 2.5:1 to 3:1 to permit substantially complete formation of the diprotonated salt, and 4:1 to permit substantially complete formation of the triprotonated salt. Also, the ratio of acid to amine should be sufficient to provide an excess of acid to maintain the pH of the concentrate composition between about 3 and 6. The amine salts do not undergo reactions in an environment where the acid is in excess.

The amine may be a monoamine, diamine, or triamine. Further, the amine may be a primary amine, a secondary amine, or a tertiary amine.

The acid is preferably a carboxylic acid. Some non-limiting examples of carboxylic acids include hydroxyacetic (glycolic) acid, citric acid, formic acid, acetic acid, propionic acid, butyric acid, valeric acid, caproic acid, gluconic acid, itaconic acid, trichloroacetic acid, lactic acid, benzoic acid, and the like. The acid is preferably acetic acid.

The amine salt is preferably an amine-acetate where the amine is a primary or secondary amine, and a diamine or triamine. Useful diamine acetates include those having the formula $$[(R^1)NH(R^2)NH_3]^+(CH_3COO)^-$$

or $$[(R^1)NH_2(R^2)NH_3^{++}](CH_3COO)_2^-$$

wherein $R^1$ is a $C_{10-18}$ aliphatic group or an ether group having the formula $R^{10}O(R^{11})$ wherein $R^{10}$ is a $C_{10-18}$ aliphatic group and $R^{11}$ is a $C_{1-5}$ alkyl group; and $R^2$ is a $C_{1-5}$ alkylene group. The preferred diamine acetates are those wherein $R^1$ is a $C_{10-18}$ aliphatic group derived from a fatty acid and $R^2$ is propylene. Representative examples of useful diamines include N-coco-1,3-propylene diamine, N-oleyl-1,3-propylene diamine, N-tallow-1,3-propylene diamine, and mixtures thereof. Such N-alkyl-1,3-propylene diamines are available from Akzo Chemie America, Armak Chemicals under the trademark Duomeen®. Representative examples of useful triamines include N-tallow-dipropylene triamine, N-coco-dipropylene triamine, N-oleyl-dipropylene triamine, and mixtures thereof. Such triamines are commercially available from Akzo Chemie America, Armak Chemicals, under the tradename Triameen®.

The amine salt is preferably an amine-acetate formed by reacting a diamine with acetic acid. The diamine is preferably N-oleyl-1,3-diamino propane, commercially available as Duomeen® OL from Akzo Nobel.

The amine salt is preferably present in the concentrate in an amount from about 0.5 to about 25 wt. %, from about 2 to about 15 wt. %, and from about 3 to about 6 wt. %.

Nonionic Surfactant

The present invention includes a nonionic surfactant for providing wetting on the conveyor surface. Some examples of nonionic surfactants include polyalkylene oxide condensates of long chain alcohols such as alkyl phenols and aliphatic fatty alcohols. Some specific examples contain alkyl chains of $C_6$-$C_{18}$. Typical examples are polyoxyethylene adducts of tall oil, coconut oil, lauric, stearic, oleic acid, and the like, and mixtures thereof. Other nonionic surfactants can be polyoxyalkylene condensates of fatty acid amines and amides having from about 8 to 22 carbon atoms in the fatty alkyl or acyl groups and about 10 to 40 alkyloxy units in the oxyalkylene portion. An exemplary product is the condensation product of coconut oil amines and amides with 10 to 30 moles of ethylene oxide. It is possible to form a block copolymer by condensing different alkylene oxides with the same fatty acid amine or amide. An example is a polyoxalkylene condensate of a long chain fatty acid amine with three blocks of oxyalkylene units wherein the first and third block consists of propylene oxide moiety and the second block consists of ethylene oxide moiety. The block copolymer may be linear or branched.

Yet another kind of nonionics are alkoxylated fatty alcohols. Typical products are the condensation products of n-decyl, n-dodecyl, n-octadecyl alcohols, and a mixture thereof with 3 to 50 moles of ethylene oxide.

Some specifically suitable nonionics for the lubricant compositions are alkylene oxide adducts of relatively low degree of polymerization alkylglycosides. These oxyalkylated glycosides comprise a fatty ether derivative of a mono-, di-, tri-, etc. saccharide having an alkylene oxide residue. Preferable examples contain 1 to 30 units of an alkylene oxide, typically ethylene oxide, 1 to 3 units of a pentose or hexose, and an alkyl group of a fatty group of 6 to 20 carbon atoms. An oxyalkylated glycoside compares with the general formula of:

$$H\text{-}(AO)_m\text{-}G_y\text{-}O\text{—}R$$

where AO is an alkylene oxide residue; m is the degree of alkyl oxide substitution having an average of from 1 to about 30, G is a moiety derived from a reducing saccharide containing 5 or 6 carbon atoms, i.e. pentose or hexose; R is saturated or nonsaturated fatty alkyl group containing 6 to 20 carbon atoms; and y, the degree of polymerization (D.P.) of the polyglycoside, represents the number of monosaccharide repeating units in the polyglycoside, is an integer on the basis of individual molecules, but may be a noninteger when taken on an average basis when used as an ingredient for lubricants.

Some specific examples include sorbitan fatty acid esters, such as the Spans® and the polyoxyethylene derivatives of sorbitan and fatty acid esters known as the Tweens®. These are the polyoxyethylene sorbitan and fatty acid esters prepared from sorbitan and fatty esters by addition of ethylene oxide. Some specific examples of these are polysorbate 20, or polyoxyethylene 20 sorbitan monolaurate, polysorbate 40, or polyoxyethylene 20 sorbitan monopalmatate, polysorbate 60, or polyoxyethylene 20 sorbitan monostearate, or polysorbate 85, or polyoxyethylene 20 sorbitan triolyate.

In a preferred embodiment, the invention can include a nonionic surfactant that is an alkylpolyglycoside. Alkylpolyglycosides do not promote stress cracking in polymeric containers. Alkylpolyglycosides (APGs) also contain a carbohydrate hydrophile with multiple hydroxyl groups.

APGs are fatty ether derivatives of saccharides or polysaccharides. The saccharide or polysaccharide groups are mono-, di-, tri-, etc. saccharides of hexose or pentose, and the alkyl group is a fatty group with 7 to 20 carbon atoms. Alkylpolyglycoside can be compared with the general formula of:

$$G_x\text{-O—R}$$

where G is moiety derived from a reducing saccharide containing 5 or 6 carbon atoms, i.e. pentose or hexose; and R is saturated or nonsaturated fatty alkyl group containing 6 to 20 carbon atoms; x, the degree of polymerization (D.P.) of the polyglycoside, representing the number of monosaccharide repeating units in the polyglycoside, is an integer on the basis of individual molecules, but may be a noninteger when taken on an average basis. In some embodiments, x has the value of less than 2.5, and in some embodiments is in the range or 1 and 2.

The reducing saccharide moiety, G can be derived from pentose or hexose. Exemplary saccharides are glucose, fructose, mannose, galactose, talose, gulose, allose, altrose, idose, arabinose, xylose, lyxose and ribose. Because of the ready availability of glucose, glucose is a common embodiment in the making of polyglycosides.

The fatty alkyl group in some embodiments is a saturated alkyl group, although unsaturated alkyl fatty group can be used. It is also possible to use an aromatic group such as alkylphenyl, alkylbenzyl and the like in place of the fatty alkyl group to make an aromatic polyglycoside.

Generally, commercially available polyglycosides have alkyl chains of $C_8$-$C_{16}$ and average degree of polymerization in the range of 1.4 to 1.6.

The nonionic surfactant is preferably one that does not promote stress cracking in polymeric containers, and an example of such a nonionic surfactant is an alkyl polyglycoside. A preferred alkylpolyglycoside is Alkadet 15, commercially available from Huntsman Corporation.

The nonionic surfactant is preferably present in the concentrate from about 0.5 to about 10 wt. %, from about 2 to about 5 wt. %, and from about 2 to about 4 wt. %.

Additional Functional Ingredients

Additional functional ingredients may optionally be used to improve the effectiveness of the composition. Some nonlimiting of such additional active ingredients can include: surfactants, neutralizing agents, stabilizing/coupling agents, dispersing agents, antiwear agents, antimicrobial agents, viscosity modifiers, sequestrants/chelating agents, biofilm reducing agents, dyes, buffers, anticorrosion agents, antistatic agents, oderants, secondary lubricants, mixtures of these, and other ingredients useful in imparting a desired characteristic or functionality in the lubricant composition. The following describes some examples of such ingredients.

Surfactants

The lubricant composition may also contain additional cationic, anionic, amphoteric, and nonionic surfactants, and mixtures thereof. For a discussion on surfactants, see Kirk-Othmer, Surfactants in Encyclopedia of Chemical Technology, 19:507-593 (2d ed. 1969), which is incorporated by reference herein.

Neutralizing Agents

The lubricant composition can also include a neutralizing agent for various purposes. Some commonly used neutralizing agents are the alkaline metal hydroxides such as potassium hydroxide and sodium hydroxide. Another class of neutralizing agent is the alkyl amines, which may be primary, secondary, or tertiary or, alkanolamines, such as monoethanolamine, diethanolamine and triethanolamine, or cyclic amines such as morpholine.

Fatty alkyl substituted amines can also be used as neutralizing agents wherein the first substitute group of the amine is a saturated or unsaturated, branched or linear alkyl group having between 8 to 22 carbon atoms, alkyl group or hydroxyalkyl group having 1 to 4 carbons, or an alkoxylate group, and the third substitute group of the amine is an alkylene group of 2 to 12 carbons bonded to a hydrophilic moiety, such as —$NH_2$, —OR, $SO_3$, amine alkoxylate, alkoxylate, and the like. These amines can be illustrated by the formula:

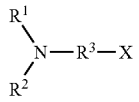

wherein $R^1$ is an alkyl group having between 8 to 22 carbon atoms, and $R^2$ is a hydrogen, alkyl group or hydroxyalkyl group having 1 to 4 carbons or an alkoxylate group, $R^3$ is an alkylene group having from 2 to 12 carbon atoms, and X is a hydrogen or a hydrophilic group such as —$NH_2$, —OR, —$SO_3$, amine alkoxylate, alkoxylate, and the like.

Examples of amines useful for neutralization are: dimethyl decyl amine, dimethyl octyl amine, octyl amine, nonyl amine, decyl amine, ethyl octyl amine, and the like, and mixtures thereof.

When X is —$NH_2$, preferable examples are alkyl propylene amines such as N-coco-1,3,diaminopropane, N-tallow-1,3,diaminopropane and the like, or mixtures thereof.

Examples of preferable ethoxylated amines are ethoxylated tallow amine, ethoxylated coconut amine, ethoxylated alkyl propylene amines, and the like, and mixtures thereof.

Stabilizing/Coupling Agents

Stabilizing agents, or coupling agents can be employed to keep the concentrate homogeneous, for example, under cold temperature. Some of the ingredients may have the tendency to phase separate or form layers due to the high concentration. Many different types of compounds can be used as stabilizers. Examples are isopropyl alcohol, ethanol, urea, octane sulfonate, glycols such as hexylene glycol, propylene glycol and the like.

Detergents/Dispersing Agents

Detergents or dispersing agents may also be added. Some examples of detergents and dispersants include alkylbenzenesulfonic acid, alkylphenols, carboxylic acids, alkylphosphonic acids, and their calcium, sodium, and magnesium salts, polybutenylsuccinic acid derivatives, silicone surfactants, fluorosurfactants, and molecules containing polar groups attached to an oil-solubilizing aliphatic hydrocarbon chain.

Some examples of suitable dispersing agents include triethanolamine, alkoxylated fatty alkyl monoamines and diamines such as coco bis(2-hydroxyethyl)amine, polyoxyethylene(5-)coco amine, polyoxyethylene(15)coco amine, tallow bis(−2 hydroxyethyl)amine, polyoxyethylene(15) amine, polyoxyethylene(5)oleyl amine and the like.

Antiwear Agents

Antiwear agents can also be added. Some examples of antiwear agents include zinc dialkyldithiophosphates, tricresyl phosphate, and alkyl and aryl disulfides and polysulfides.

The antiwear and/or extreme pressure agents are used in amounts to give the desired results.

Antimicrobial Agents

Antimicrobial agents can also be added. Some useful antimicrobial agents include disinfectants, antiseptics, and preservatives. Some non-limiting examples include phenols including halo- and nitrophenols and substituted bisphenols such as 4-hexylresorcinol, 2-benzyl-4-chlorophenol and 2,4,4'-trichloro-2'-hydroxydiphenyl ether, organic and inorganic acids and its esters and salts such as dehydroacetic acid, peroxycarboxylic acids, peroxyacetic acid, methyl p-hydroxy benzoic acid, cationic agents such as quaternary ammonium compound, phosphonium compounds such as tetrakishydroxymethyl phosphonium sulphate (THPS), aldehydes such as glutaraldehyde, antimicrobial dyes such as acridines, triphenylmethane dyes and quinines and halogens including iodine and chlorine compounds. The antimicrobial agents can be used in amounts to provide the desired antimicrobial properties.

Viscosity Modifiers

Viscosity modifiers can also be used. Some examples of viscosity modifiers include pour-point depressants and viscosity improvers, such as polymethacrylates, polyisobutylenes, polyacrylamides, polyvinyl alcohols, polyacrylic acids, high molecular weight polyoxyethylenes, butyl glucoside, and polyalkyl styrenes. The modifiers can be used in amounts to provide the desired results.

Sequestrants/Chelating Agents

The lubricant composition may include a sequestrant or chelating agent. For example, where soft water is unavailable and hard water is used there is a tendency for the hardness cations, such as calcium, magnesium, and ferrous ions, to reduce the efficacy of the surfactants, and even form precipitates when coming into contact with ions such as sulfates, and carbonates. Sequestrants can be used to form complexes with the hardness ions. A sequestrant molecule may contain two or more donor atoms which are capable of forming coordinate bonds with a hardness ion. Sequestrants that possess three, four, or more donor atoms are called tridentate, tetradentate, or polydentate coordinators. Generally the compounds with the larger number of donor atoms are better sequestrants. The preferable sequestrant is ethylene diamine tetracetic acid (EDTA), such as Versene products which are $Na_2EDTA$ and $Na_4EDTA$ sold by Dow Chemicals. Some additional examples of other sequestrants include: iminodisuccinic acid sodium salt, trans-1,2-diaminocyclohexane tetracetic acid monohydrate, diethylene triamine pentacetic acid, sodium salt of nitrilotriacetic acid, pentasodium salt of N-hydroxyethylene diamine triacetic acid, trisodium salt of N,N-di(beta-hydroxyethyl)glycine, sodium salt of sodium glucoheptonate, and the like.

Biofilm Reducing Agents

Biofilm reducing agents may optionally be included in the composition. Biofilms are a biological matrix formed on surfaces that contact water. Biofilms usually contain pathogens such as harmful bacteria. These pathogens are protected by the matrix from typical biocides and are therefore harder to kill than most pathogens. Biofilm growth and removal depend on several factors including the surface composition, and chemical composition of the surrounding environment.

There are several ways of removing biofilms including physically, chemically, and biologically. Examples of ways to physically remove biofilms include using magnetic fields, ultra sound, and high and low electrical fields. Physically removing the biofilms can be combined with chemical or biological methods of removing the biofilm. Examples of chemical and biological ways of removing biofilms include using a biofilm reducing agent. Examples of biofilm reducing agents are chelating agents such as EDTA and EGTA, chlorine, iodine, hydrogen peroxide, and antimicrobial proteins such as nisin such as that produced by *Lactococcus lactus*. Chelating agents destabilize the outer cell membrane of the biofilm. Chlorine, iodine, and hydrogen peroxide remove biofilms by depolymerizing the matrix.

Dyes and Oderants

Various dyes and oderants including perfumes and other aesthetic enhancing agents may also be included in the composition. Dyes may be included to alter the appearance of the composition or used as a monitoring tool, as for example, any water soluble or product soluble dye, any FD&C approved dye, Direct Blue 86 (Miles), Fastusol Blue (Mobay Chemical Corp), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keyston Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the composition include for example terpenoids such as citronellol, aldehydes such as amyl cinnamaldehyde, a jasmine such as C1S-jasmine or jasmal, vanillin, and the like.

Buffers

The composition may optionally include a buffer. Some non-limiting examples of suitable buffers include citrates, phosphates, borates, and carbonates.

Anticorrosion Agents

The composition may optionally include an anticorrosion agent. Anticorrosion agents provide compositions that generate surfaces that are shiner and less prone to biofilm buildup than surfaces that are not treated with anticorrosion agents. Preferred anticorrosion agents which can be used according to the invention include phosphonates, phosphonic acids, triazoles, organic amines, sorbitan esters, carboxylic acid derivatives, sarcosinates, phosphate esters, zinc, nitrates, chromium, molybdate containing components, and borate containing components. Exemplary phosphates or phosphonic acids are available under the name Dequest (i.e., Dequest 2000, Dequest 2006, Dequest 2010, Dequest 2016, Dequest 2054, Dequest 2060, and Dequest 2066) from Solutia, Inc. of St. Louis, Mo. Exemplary triazoles are available under the name Cobratec (i.e., Cobratec 100, Cobratec TT-50-S, and Cobratec 99) from PMC Specialties Group, Inc. of Cincinnati, Ohio. Exemplary organic amines include aliphatic amines, aromatic amines, monoamines, diamines, triamines, polyamines, and their salts. Exemplary amines are available under the names Amp (i.e. Amp-95) from Angus Chemical Company of Buffalo Grove, Ill.; WGS (i.e., WGS-50) from Jacam Chemicals, LLC of Sterling, Kans.; Duomeen (i.e., Duomeen O and Duomeen C) from Akzo Nobel Chemicals, Inc. of Chicago, Ill.; DeThox amine (C Series and T Series) from DeForest Enterprises, Inc. of Boca Raton, Fla.; Deriphat series from Henkel Corp. of Ambler, Pa.; and Maxhib (AC Series) from Chemax, Inc. of Greenville, S.C. Exemplary sorbitan esters are available under the name Calgene (LA-series) from Calgene Chemical Inc. of Skokie, Ill. Exemplary carboxylic acid derivatives are available under the name Recor (i.e., Recor 12) from Ciba-Geigy Corp. of Tarrytown, N.Y. Exemplary sarcosinates are available under the names Hamposyl from Hampshire Chemical Corp. of Lexington, Mass.; and Sarkosyl from Ciba-Geigy Corp. of Tarrytown, N.Y.

The composition optionally includes an anticorrosion agent for providing enhanced luster to the metallic portions of a surface.

Antistatic Agents

An antistatic agent may optionally be included in the composition. Examples of antistatic agents include long-chain amines, amides, and quaternary ammonium salts; esters of fatty acids and their derivatives; sulfonic acids and alkyl aryl sulfonates; polyoxyethylene derivatives; polyglycols and their derivatives; polyhydric alcohols and their derivatives; and phosphoric acid derivatives.

Secondary Lubricants

A variety of lubricants and secondary lubricants can be employed in the compositions, including hydroxy-containing compounds such as polyols (e.g., glycerol and propylene glycol); polytetrafluoroethylene (e.g. TEFLON®); polyalkylene glycols (e.g., the CARBOWAX™ series of polyethylene and methoxypolyethylene glycols, commercially available from Union Carbide Corp.); linear copolymers of ethylene and propylene oxides (e.g., UCON™ 50-HB-100 water-soluble ethylene oxide:propylene oxide copolymer, commercially available from Union Carbide Corp.); and sorbitan esters (e.g., TWEEN™ series 20, 40, 60, 80 and 85 polyoxyethylene sorbitan monooleates and SPAN™ series 20, 80, 83 and 85 sorbitan esters, commercially available from ICI Surfactants). Other suitable lubricants and secondary lubricants include phosphate esters, amines and their derivatives, and other commercially available lubricants and secondary lubricants that will be familiar to those skilled in the art. Derivatives (e.g., partial esters or ethoxylates) of the above lubricants can also be employed. For applications involving plastic containers, care should be taken to avoid the use of lubricants that might promote environmental stress cracking in plastic containers. Finally, a variety of silicone materials can be employed as a secondary lubricant, including silicone emulsions (such as emulsions formed from methyl (dimethyl), higher alkyl and aryl silicones; functionalized silicones such as chlorosilanes; amino-, methoxy-, epoxy- and vinyl substituted siloxanes; and silanols). Suitable silicone emulsions include E2175 high viscosity polydimethylsiloxane (a 60% siloxane emulsion commercially available from Lambent Technologies, Inc.), E2145 FG food grade intermediate viscosity polydimethylsiloxane (a 35% siloxane emulsion commercially available from Lambent Technologies, Inc.), HV490 high molecular weight hydroxy-terminated dimethyl silicone (an anionic 30-60% siloxane emulsion commercially available from Dow Corning Corporation), SM2135 polydimethylsiloxane (a nonionic 50% siloxane emulsion commercially available from GE Silicones) and SM2167 polydimethylsiloxane (a cationic 50% siloxane emulsion commercially available from GE Silicones. Other silicone materials include finely divided silicone powders such as the TOSPEARL™ series (commercially available from Toshiba Silicone Co. Ltd.); and silicone surfactants such as WP30 anionic silicone surfactant, WAXWS-P nonionic silicone surfactant, QUATQ-400M cationic silicone surfactant and 703 specialty silicone surfactant (all commercially available from Lambent Technologies, Inc.). Preferred silicone emulsions typically contain from about 30 wt. % to about 70 wt. % water. Non-water-miscible silicone materials (e.g., non-water-soluble silicone fluids and non-water-dispersible silicone powders) can also be employed in the composition if combined with a suitable emulsifier (e.g., nonionic, anionic or cationic emulsifiers). For applications involving plastic containers (i.e., PET beverage bottles), care should be taken to avoid the use of emulsifiers or other surfactants that promote environmental stress cracking in plastic containers.

For a more complete understanding of the invention, the following examples are given to illustrate some embodiments. These examples and experiments are to be understood as illustrative and not limiting. All parts are by weight, except where it is contrarily indicated.

EXAMPLES

The following chart provides a brief explanation of certain chemical components used in the following examples:

TABLE 1

Trade Names and Corresponding Descriptions of Some Chemicals Used in the Examples

| Trademark/Chemical Name | Description | Provider |
|---|---|---|
| | Acetic Acid 75% | Redox Chemicals |
| Duomeen OL | N-oleyl-1,3-diaminopropane | Akzo Nobel |
| T-Mulz 800 | Phosphate Ester | Harcros Organics |
| Monafax 831 | Deceth-4 Phosphate | Uniqema |
| Rhodafac RA 600 | Polyoxyethylene Alkyl Phosphate Ester Acid | Rhodia |
| Alkadet 15 | Alkyl Polysaccharide | Huntsman Corporation |

Example 1

Example 1 tested the ability of the present invention to provide lubrication on glass bottle lines. For this example Formula 1 was tested against a known conveyor lubricant LUBODRIVE™, an amine based conveyor lubricant, commercially available from Ecolab Inc. (St. Paul, Minn.). The formula for Formula 1 is provided in table 2. The formula is provided in wt. %.

TABLE 2

Conveyor Lubricant Formula Formula 1

| | |
|---|---|
| Soft Water | 80.444 |
| Acetic Acid (75%) | 7.300 |
| Duomeen OL | 3.000 |
| Rhodafac RA 600 | 6.000 |
| Alkadet 15 | 3.000 |
| Potassium Hydroxide | 0.256 |

The Formula 1 and the LUBODRIVE™ lubricant were tested on a stainless steel conveyor running 300 ml and 1800 ml glass bottles at 550 bottles per minute and 300 bottles per minute respectively. The coefficient of friction was measured in various places along the conveyor line. During production runs, a test container representative of the packaging used on the production line was connected to a strain gauge by a synthetic line and placed on the moving production line conveyor. The test container was allowed to drag freely for approximately 30 seconds so that only friction and gravitational forces were action in it. The frictional force was recorded after 30 seconds. This method was repeated a number of times to obtain an average coefficient of friction. The results are provided in Table 3.

TABLE 3

| Coefficient of Friction for Glass Bottle on Stainless Steel Conveyor | | | |
|---|---|---|---|
| | | Coefficient of Friction | |
| | Test Site | Formula 1 | LUBODRIVE ™ |
| 300 ml Glass Bottles on Stainless Steel Conveyor | | | |
| 1 | Sorting Conveyor Before Bottle Wash | 0.120 | 0.135 |
| 2 | After the Bottle Wash Conveyor | 0.115 | 0.130 |
| 3 | After the Labeling Conveyor | 0.120 | 0.135 |
| | Average | 0.118 | 0.133 |
| 1800 ml Glass Bottles on Stainless Steel Conveyor | | | |
| 1 | Sorting Conveyor Before Bottle Wash | 0.125 | 0.159 |
| 2 | After Bottle Wash Conveyor | 0.120 | 0.144 |
| 3 | After Labeling Conveyor | 0.125 | 0.159 |
| | Average | 0.123 | 0.154 |

Table 3 shows that the Formula 1 had better lubrication for glass bottles on stainless steel than the LUBODRIVE™ lubricant, a known conveyor lubricant.

Example 2

Example 2 compared the foam generation of the present invention to other known lubricants. For this example the formulas in Table 4 were compared with LUBODRIVE GLF™, and LUBOKLAR XT™, two amine-based conveyor lubricants, commercially available from Ecolab Inc. (St. Paul, Minn.). The formulas in Table 4 are listed in wt. %.

TABLE 4

| Formulas | | | | |
|---|---|---|---|---|
| | Formula 2 | Formula 3 | Formula 4 | Formula 5 |
| Soft Water | 86.6400 | 86.1300 | 84.37 | 85.42 |
| Acetic Acid (75%) | 2.4400 | 1.7400 | 1.70 | 3.19 |
| Duomeen OL | 4.0600 | 3.0000 | 2.94 | 5.90 |
| Rhodafac RA 600 | 4.0800 | 6.1300 | 8.05 | 2.95 |
| Alkadet 15 | 2.7800 | 3.0000 | 2.94 | 3.00 |

For this example, 0.2 wt. % lubricant solutions of the formulas in Table 4 with water were recirculated through a temperature regulated stainless steel/glass cylindrical tank connected to a recirculation system. The recirculation system consisted of a pressure regulator and water pump connected in series to the tank by stainless steel pipes. The in-feed to the recirculation system was located at the base of the tank and water was fed back into the cylinder through a CIP nozzle located near the top of the tank. Pressure was regulated to 140 kPa (kilopascals) and the experiments were done at a temperature of 20° C. The generation of foam was recorded at 5 minute intervals over 25-30 minutes. The height of the foam was measured in centimeters. The results are shown in Table 5.

TABLE 5

| Foam Generation Data for Lube Solutions | | | | | | |
|---|---|---|---|---|---|---|
| Time | Formula 2 | Formula 3 | Formula 4 | Formula 5 | Lubodrive GLF | Luboklar XT |
| | Foam Height in cm | | | | | |
| 0 | 0 | 0 | 0 | 0 | 0 | 0 |
| 5 | 1 | 1 | 1 | 6 | 6 | 8 |
| 10 | 2 | 2 | 1 | 8 | 9 | 14 |
| 15 | 2 | 1 | 1 | 10 | 13 | 18 |
| 20 | 2 | 1 | 1 | 11 | 16 | 21 |
| 25 | 2 | 1 | 1 | 12 | 19 | 23 |
| 30 | 2 | 1 | 1 | 12 | 20 | 25 |

Table 5 shows that Formulas 2-5 of the present invention produced less foam than known conveyor lubricants, especially Formulas 2-4.

Example 3

Example 3 compared the ability of various lubricants to lubricate glass bottles on a stainless steel surface. For this example, 0.2 wt. % solutions of the formulas in Table 4 were used along with LUBODRIVE GLF™ and LUBODRIVE NF™, a phosphate ester lube, commercially available from Ecolab Inc. (St. Paul, Minn.). For this example, the formulas were tested using the short track test.

Short Track Test

For the test, 600 mL PET bottles of Mount Franklin Mineral Water were used for the PET containers, two 373 mL cans of Pepsi® were used for the can containers, and two 373 mL Victoria Bitter bottles were used for the glass containers. For the test, the mass of the container was determined. Then the container or containers were connected by a string to a strain gauge. The containers and the strain gauge were placed on the desired track with lubricant and the track was allowed to run for 30 seconds. After 30 seconds, the force was measured.

The results for Example 3 are shown in Table 6.

TABLE 6

| Lubrication of Glass Container on Stainless Steel Conveyor | |
|---|---|
| Formula | Frictional Force (cN) |
| Water Alone | 160 |
| Formula 2 | 105 |
| Formula 3 | 95 |
| Formula 4 | 100 |
| Formula 5 | 110 |
| Lubodrive GLF | 120 |
| Lubodrive NF | 120 |

Table 6 shows that the present invention is better at lubricating glass on stainless steel that two known conveyor lubricants.

Example 4

Example 4 compared the ability of various lubricants to lubricate glass bottles on an acetal surface. For this example, 0.2 wt. % solutions of the formulas in Table 4 were used along with LUBODRIVE GLF™ and LUBODRIVE NF™. The short track test used in Example 3 was also used for this example. The results are shown in Table 7.

TABLE 7

| Lubrication of Glass on Acetal | |
|---|---|
| Formula | Frictional Force (cN) |
| Water Alone | 70 |
| Formula 2 | 55 |
| Formula 3 | 55 |
| Formula 4 | 55 |
| Formula 5 | 55 |
| Lubodrive GLF | 55 |
| Lubodrive NF | 50 |

Table 7 shows that the present invention is comparable to known lubricants at lubricating glass bottles on an acetal surface.

Example 5

Example 5 compared the ability of various lubricants to lubricate cans on a stainless steel surface. For this example, 0.2 wt. % solutions of the formulas in Table 4 were used along with LUBODRIVE GLF™ and LUBODRIVE NF™. The short track test procedure used in Example 3 was also used for this example. The results are shown in Table 8.

TABLE 8

| Lubrication of Cans on Stainless Steel | |
|---|---|
| Formula | Frictional Force (cN) |
| Water Alone | 110 |
| Formula 2 | 80 |
| Formula 3 | 55 |
| Formula 4 | 65 |
| Formula 5 | 80 |
| Lubodrive GLF | 80 |
| Lubodrive NF | 80 |

Table 8 shows that the present invention is comparable to or better than known conveyor lubricants at lubricating cans on a stainless steel surface.

Example 6

Example 6 compared the ability of various lubricants to lubricate cans on an acetal surface. For this example, 0.2 wt. % solutions of the formulas in Table 4 were used along with LUBODRIVE GLF™ and LUBODRIVE NF™. The short track test used in Example 3 was also used for this example. The results are shown in Table 9.

TABLE 9

| Lubrication of Cans on Acetal | |
|---|---|
| Formula | Frictional Force (cN) |
| Water Alone | 70 |
| Formula 2 | 50 |
| Formula 3 | 35 |
| Formula 4 | 35 |
| Formula 5 | 40 |
| Lubodrive GLF | 55 |
| Lubodrive NF | 45 |

Table 9 shows that the present invention is comparable or better than known conveyor lubricants at lubricating cans on an acetal surface.

Example 7

Example 7 compared the ability of various lubricants to lubricate PET containers on a stainless steel surface. For this example, 0.2 wt. % solutions of the formulas in Table 4 were used along with LUBODRIVE GLF™ and LUBODRIVE NF™. The short track test used in Example 3 was also used for this example. The results are shown in Table 10.

TABLE 10

| Lubrication of PET Containers on Stainless Steel | |
|---|---|
| Formula | Frictional Force (cN) |
| Water Alone | 150 |
| Formula 2 | 120 |
| Formula 3 | 110 |
| Formula 4 | 140 |
| Formula 5 | 140 |
| Lubodrive GLF | 135 |
| Lubodrive NF | 135 |

Table 10 shows that the present invention is better than known conveyor lubricants at lubricating PET containers on a stainless steel surface.

Example 8

Example 8 compared the ability of various lubricants to lubricate PET containers on an acetal surface. For this example, 0.2 wt. % solutions of the formulas in Table 4 were used along with LUBODRIVE GLF™ and LUBODRIVE NF™. The short track test used in Example 3 was also used for this example. The results are shown in Table 11.

TABLE 11

| Lubrication of PET Containers on Acetal | |
|---|---|
| Formula | Frictional Force (cN) |
| Water Alone | 130 |
| Formula 2 | 80 |
| Formula 3 | 75 |
| Formula 4 | 80 |
| Formula 5 | 85 |
| Lubodrive GLF | 85 |
| Lubodrive NF | 70 |

Table 11 shows that the present invention is comparable to or better than known conveyor lubricants at lubricating PET containers on an acetal surface.

The foregoing summary, detailed description, and examples provide a sound basis for understanding the invention, and some specific example embodiments of the invention. Since the invention can comprise a variety of embodiments, the above information is not intended to be limiting. The invention resides in the claims.

What is claimed is:

1. A conveyor lubricant concentrate composition comprising:

a) an alkyl alkoxylated phosphate ester;

b) an amine acetate salt; and c) an alkyl polyglycoside surfactant wherein a use solution comprising the concentrate composition is stable to phase separation and generates less than 10 centimeters of foam during up to 15 minutes of use.

2. The composition of claim 1, wherein the alkyl polyglycoside surfactant does not promote stress cracking.

3. The composition of claim 1, further comprising an acid.

4. The composition of claim 3, further comprising an amine, wherein the ratio of acid to amine is at least 1:1.

5. The composition of claim 4, wherein the amine is a diamine.

6. The composition of claim 1, further comprising additional functional ingredients.

7. The composition of claim 6, wherein the additional functional ingredients are selected from the group consisting of surfactants, neutralizing agents, stabilizing agents, coupling agents, dispersing agents, antiwear agents, antimicrobial agents, viscosity modifiers, sequestrants, chelating agents, biofilm reducing agents, dyes, anticorrosion agents, antistatic agents, oderants, secondary lubricants, and mixtures thereof.

8. The composition of claim 1, wherein a) the alkyl alkoxylated phosphate ester is present from about 1 to about 20 wt. %; and b) the amine salt is present from about 0.5 to about 25 wt. %.

9. The composition of claim 1, wherein the composition is diluted with water to form a dilute lubricant solution.

10. A low foaming conveyor lubricant use solution composition comprising:

a) an alkyl alkoxylated phosphate ester;

b) an amine acetate salt;

c) an alkyl polyglycoside surfactant; and d) water, wherein the composition is stable to phase separation and generates less than 10 centimeters of foam during up to 15 minutes of use.

11. The composition of claim 10, wherein the alkyl polyglycoside surfactant does not promote stress cracking.

12. The composition of claim 10, further comprising an acid.

13. The composition of claim 12, further comprising an amine, wherein the ratio of acid to amine is at least 1:1.

14. The composition of claim 13, wherein the amine is a diamine.

15. The composition of claim 10, further comprising additional functional ingredients.

16. The composition of claim 15, wherein the additional functional ingredients are selected from the group consisting of surfactants, neutralizing agents, stabilizing agents, coupling agents, dispersing agents, antiwear agents, antimicrobial agents, viscosity modifiers, sequestrants, chelating agents, biofilm reducing agents, dyes, anticorrosion agents, antistatic agents, oderants, secondary lubricants, and mixtures thereof.

17. A low foaming conveyor lubricant use solution composition comprising:

a) an alkyl alkoxylated phosphate ester;

b) an amine acetate salt;

c) an alkyl polyglycoside surfactant; and d) water, wherein the composition is stable to phase separation and generates less than 10 centimeters of foam during up to 15 minutes of use.

* * * * *